US006984794B2

(12) United States Patent
Kawamura

(10) Patent No.: US 6,984,794 B2
(45) Date of Patent: Jan. 10, 2006

(54) SWITCH DEVICE

(75) Inventor: Takashi Kawamura, Fukuoka (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/900,367

(22) Filed: Jul. 28, 2004

(65) Prior Publication Data

US 2005/0067264 A1 Mar. 31, 2005

(30) Foreign Application Priority Data

Sep. 29, 2003 (JP) ..... P.2003-338440
Jan. 26, 2004 (JP) ..... P.2004-017646

(51) Int. Cl.
*H01H 19/58* (2006.01)

(52) U.S. Cl. ..... 200/14

(58) Field of Classification Search . 200/11 R–11 TW, 200/564–572, 292, 303, 302.1, 302.2, 302.3
See application file for complete search history.

(56) References Cited

U.S. PATENT DOCUMENTS 3,196,237 A * 7/1965 Westgate, Jr. ..... 200/303 X
3,772,485 A * 11/1973 Workings ..... 200/11 TW
4,045,637 A * 8/1977 Mongeau ..... 200/303
5,008,498 A * 4/1991 Yamazaki ..... 200/303 X

FOREIGN PATENT DOCUMENTS

JP 9-63420 3/1997

* cited by examiner

*Primary Examiner*—Michael A. Friedhofer
(74) *Attorney, Agent, or Firm*—Whitham, Curtis & Christofferson, PC

(57) ABSTRACT

A switch device includes a base member which includes a containing portion, the containing portion having a bottom face, side faces and upper opening, a switching unit which is slidably provided on the bottom face, a cover member which is attached to the base member so as to cover the upper opening of the containing portion, and the cover member having an operation hole, an operating member which rotates for a first switching function and slides in a sliding direction for a second switching function, and a connecting portion which connects the operating member with the switching unit through the operation hole.

14 Claims, 5 Drawing Sheets

SWITCH DEVICE

BACKGROUND OF THE INVENTION

The present invention relates to a switch device. More particularly, the present invention relates to a composite operation type switch device in which different switches are respectively operated according to a plurality of different actions of a rotating operation and a pushing operation of one dial member which is operated by a user.

Concerning the composite operation type switch device which is used as a part for inputting a signal into an electronic apparatus such as a video camera, digital camera, or cellular phone, a plurality of switches must be smoothly and continuously operated so as to conduct a predetermined processing. Therefore, the part used for inputting a signal into the electronic apparatus is composed in such a manner that a plurality of switches can be individually operated only when one operation member is operated by a user (For example, refer to JP-A-9-63420.).

A composite operation type switch device described in JP-A-9-63420 includes: a dial member which is rotated and slidably moved; a base having a stationary contact point; a support shaft, one end of which is fixed to the dial member and the other end of which passes through the base perpendicularly, capable of sliding in the sliding direction of the dial member, pivotally attached to the base; a rotary plate attached to the support shaft so that the rotary plate can be rotated integrally with the support shaft; and a slide member which slides on the base together with the support shaft. The composite operation type switch device is composed so that the following operation can be made. When the dial member is rotated together with the support shaft, a switching function is exerted between the rotary plate and the slide member. When the dial member is slid, the support shaft and the slide member are integrally slid in the sliding direction, and the switching function is exerted between the slide member and the base.

Concerning the composite operation type switch device as described above, in many cases, mounting is conducted in such a manner that the base is arranged and mounted on the circuit board by the reflow soldering method.

The related composite operation type switch device has the following problems. As described above in the related composite operation type switch device, the support shaft, which is rotated and slid together with the dial member, perpendicularly passes through the hole formed on the base and attached to the base. Therefore, in the case where the composite operation type switch device is mounted on the board, flux intrudes inside from a gap formed between the base hole and the support shaft.

SUMMARY OF THE INVENTION

Therefore, it is necessary to provide a structure in which no flux intrudes inside the switch device even when the switch device is mounted on the circuit board by the reflow soldering method. Technical problems arise when a switch device is mounted onto a circuit board by the traditional reflow soldering method. It is an object of the present invention to solve these problems.

In order to achieve the above object, according to the present invention, there is provided a switch device, comprising:

a base member, which includes a containing portion, the containing portion having a bottom face, side faces and an upper opening;

a switching unit, which is slidably provided on the bottom face;

a cover member, which is attached to the base member so as to cover the upper opening of the containing portion, and the cover member having an operation hole;

an operating member, which rotates for a first switching function and which slides in a sliding direction for a second switching function; and a connecting portion, which connects the operating member with the switching unit through the operation hole.

Preferably, the containing portion is embedded in the base member.

Preferably, the bottom face and the side faces are integrally formed so as to define a hermetically sealed space in the containing portion.

Preferably, a base member is made of resin.

Preferably, the switching unit includes a rotary member and a slide member. The rotary member is connected to the connecting portion and has a first switch element for the first switch function. The slide member is attached to the rotary member, and slides on the bottom face together with the rotary member in the sliding direction. The base member includes a stationary contact element and a second switch element for the second switching function which are provided on the bottom face of the containing portion. The slide member has a plurality of first slide elements, which sliding-contact the stationary contact element and the second switch element respectively, and has a second slide element, which sliding-contacts the first switch element.

Preferably, the first switch element on the rotary member is formed as a conductive pattern. The second slide element is formed as an elastic slide piece in the cantilever manner, the elastic slide piece having a first end, which is fixed to the slide member, and a second end, which is continuously urged to the conductive pattern on the rotary member.

According to these embodiments, the bottom face and the side faces of the containing portion are closed, and no gaps are formed so that flux can not intrude into the containing portion. Therefore, when the switch device is subjected to reflow soldering, even when reflow solder comes into contact with a lower face of the base member, no flux of the reflow solder intrudes into the containing portion.

Preferably, the first switch element on the rotary member is formed as a conductive pattern. The second slide element is formed as an elastic slide piece in the cantilever manner, the elastic slide piece having a first end, which is fixed to the slide member, and a second end, which is continuously urged to the conductive pattern on the rotary member.

According to this embodiment, the elastic sliding piece of the cantilever system is pushed to the conductive pattern side for the first switching function constantly, and the conductive pattern for the first switching function and the sliding piece are slid on each other while the pushing force is being maintained. Therefore, the conductive pattern of the first switch and the sliding piece can in continuous and secure contact with each other.

Preferably, the stationary contact element and the second switch element are formed as conductive patterns. The first slide element is formed as an elastic slide piece in the cantilever manner, the elastic slide piece having a first end, which is fixed to the slide member, and a second end, which is continuously urged to the conductive pattern on the base member.

According to this embodiment, the elastic sliding piece of the cantilever system is pushed to the conductive pattern side for the second switching function constantly, and sliding is performed while the pushing force is being maintained. Therefore, the conductive pattern side in the second switching function and the sliding piece can in continuous and secure contact with each other.

Preferably, the switch device further comprising a first urging member which is provided in the containing portion to continuously urge the slide member in one direction. The first urging member has a first free end, which is abutted against the side face of the containing portion, and a second free end, which is abutted against the slide member.

According to this embodiment, the slide member is pushed in one direction by a continuous urging force of the first urging member. Accordingly, when a user releases an external force in the sliding direction given to the operating member, the operating member and the slide member are automatically returned to a predetermined initial position by the urging force of the first urging member. Further, the first urging member can be prevented from jumping out from the base member by the connecting portion provided on the slide member until the completion of assembling.

Preferably, a notch portion is formed on an outer periphery of the side wall of the containing portion at a rear end side in the sliding direction of the slide member.

Preferably, the notch portion of the containing portion is recessed toward a center side of the rotary member.

In the above configuration, the outer periphery of the rotary member is largely protruded to an outside rather than the outer face of the side wall by an amount in which the outer face of the side wall closed to the center side of the rotary member. In a case that the composite operation type switch device is attached to the inside of the device with reference to the outer face of the side wall, the composite operation type switch device is entirely positioned toward an outer side of the device by a notched amount in which the peak of the side wall is notched by the notch portion. As a result, the rotary member is largely protruded to the exterior from the device resulting in a structure that is easily operated by the user. Furthermore, decreasing the major diameter of the rotary member to miniaturize the composite operation type switch device results in an increase of the freedom of design.

Preferably, the rotary member has a recess portion on an outer circumference thereof. The slide member has a second urging member for click feeling coming into pressure contact with the outer circumference of the rotary member. The second urging member has a protrusion which is engaged with the recess portion. A click is generated when the rotary member is rotated.

According to this embodiment, when the protrusion is engaged with or disengaged from the recess portion for click feeling of the rotary member, a click can be generated. Accordingly, the user can easily recognize a quantity of rotation of the operating member by the feeling of click. When the protrusion of the urging member for click feeling is engaged with the central protrusion provided in the slide member, deflection to the right and left of the rotary member caused by rotation can be prevented, and fluctuation of the stopping position of the operating member can be prevented.

Preferably, an outer shape of the protrusion is substantially the same as an inner shape of the recess portion of the rotary member. The protrusion is substantially tightly engaged in the recess portion of the rotary member.

According to this embodiment, when the rotary member is stopped at a position where the protrusion of the urging member for click feeling is engaged in the recess portion for click feeling of the rotary member, the rotary member is given an urging force from the urging member for click feeling at this stopping position, and the rotary member can be held without being rotated under the condition that deflection to the right and left is prevented.

Preferably, the base member has a first engaging portion provided on a side face thereof. The cover member has a second engaging portion provided on a side edge thereof. The first engaging portion is engaged with the second engaging portion when the cover member is attached to the base member.

According to this embodiment, when the first engaging portion provided on the cover are slid on both sides of the base member, the second engaging portion are engaged with the first engaging portion. Due to this engagement, the cover can not come out of the base member, and the cover can be easily attached to the base member.

Preferably, the rotary member is made of resin. The connecting portion has a protruding pin which is provided on the rotary member. The operating member has an attaching hole through which the protruding pin passes. The protruding pin passes from one side of the operating member to the other side of the operating member through the attaching hole. A part of the protruding pin, which has passed to the other side of the operating member, is calked so as to lock the protruding pin on the operating member so that the rotary member and the operating member are integrated with the cover member into one body.

According to this embodiment, the protruding pin is protruded from the inside of the cover to the outside via the through hole, and the thus protruded pin is inserted into the attaching hole of the operating member, and the pin, which has passed the attaching hole of the operating member, is calked outside the operating member. Due to the foregoing, while the cover member is being interposed between the operating member and the rotary member, the operating member and the rotary member can be integrated into one body so that they can be rotated and slid.

Preferably, the rotary member has a shaft portion. The slide member has a bearing hole with which the shaft portion is rotatably engaged.

According to this embodiment, one end side of the rotary member is supported by the through hole of the cover, and the other end side is supported when it is engaged in the bearing hole of the slide member. Therefore, both sides of the rotary member are respectively, stably supported by the through hole of the cover member and the bearing hole of the slide member.

In the above switch device, no gaps are formed on the bottom face and the side faces of the base member so that no flux can intrude into the device. Therefore, even when mounting is conducted with solder by the reflow soldering method, no flux of the reflow solder intrudes inside. Accordingly, it is possible to provide a composite operation type switch device to which the reflow soldering method is suitably applied.

The sliding pieces of the cantilever system for the first switch are continuously pushed to the conductive pattern on the rotary member, and the rotary member is rotated together with the operating member under the condition that the pushing motion is maintained. Therefore, the sliding pieces can be continuously and securely contacted with the conductive pattern in the first switch, and the reliability of operation can be enhanced.

The sliding pieces of the cantilever system for the second switch are continuously pushed to the conductive pattern side of the base, and the slide member slides together with the operating member under the condition that the pushing motion is maintained. Therefore, the sliding pieces can be continuously and securely contacted with the conductive pattern in the second switch, and the reliability of operation can be enhanced.

When a user releases an external force given to the operating member in the sliding direction, the operating member and the slide member are automatically returned to the initial position by a continuous urging force of the urging member. Therefore, it is possible to expect the enhancement in the operation property. Further, by the contacting portion provided in the slide member, the urging member can be prevented from jumping out from the base member.

When the protruding portion of the urging member for click feeling is engaged with or disengaged from the recess portion for click feeling of the rotary member, a click can be generated. Accordingly, the user can easily recognize a quantity of rotation of the operating member by the feeling of click. Therefore, it is possible to expect the enhancement in the operation property. When the protrusion of the spring for click feeling is engaged with the central protrusion provided in the slide member, deflection to the right and left of the rotary member caused by rotation can be prevented, and fluctuation of the stopping position of the operating member can be prevented.

Since an outside shape of the protrusion of the urging member for click feeling is substantially the same as an inside shape of the recess portion for click feeling of the rotary member and the protrusion of the urging member for click feeling can be substantially tightly engaged in the recess portion for click feeling of the rotary member, when the rotary member is stopped at the position where the protrusion of the spring for click feeling is engaged in the recess portion for click feeling of the rotary member and a click feeling can be obtained, the rotary member and the operating member can be held at the stopping position under the condition that no rattle is caused in the rotating direction.

When the engaging pieces provided on the cover are slid on both sides of the base member, the engaging holes of the engaging pieces are engaged with the engaging pawls. Due to this engagement, the cover can not come out of the base, and the cover can be easily attached to the base. Accordingly, the assembling work can be simplified.

The protruding pin is protruded from the inside of the cover to the outside, and the thus protruded pin is inserted into the attaching hole of the operating member, and the pin, which has penetrated the attaching hole of the operating member, is calked outside the rotary member. Due to the foregoing, while the cover is being interposed between the operating member and the rotary member, the operating member and the rotary member can be integrated into one body so that they can be rotated and slid. Accordingly, the assembling work can be further simplified.

Both sides of the rotary member are stably supported by the through hole of the cover and the bearing hole of the slide member. Therefore, the rotary member and the operating member connected to the rotary member can be stably held.

In order to attain an object of obtaining a structure in which no flux intrudes inside a switch device even when the switch device is mounted on a board by the reflow soldering method, a containing portion, the bottom face and the side of which are respectively closed, is formed on the base, the upper face of which is covered with a cover, and the switching elements are arranged in the containing portion. When the above structure is adopted, even when reflow solder comes into contact with the lower side of the base member in the case where the composite operation type switch device is subjected to reflow soldering, since the bottom face side of the base is closed, no flux intrudes from the bottom face side into the containing portion. Due to the foregoing, it is possible to obtain a composite operation type switch device which can be mounted by the reflow soldering method.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
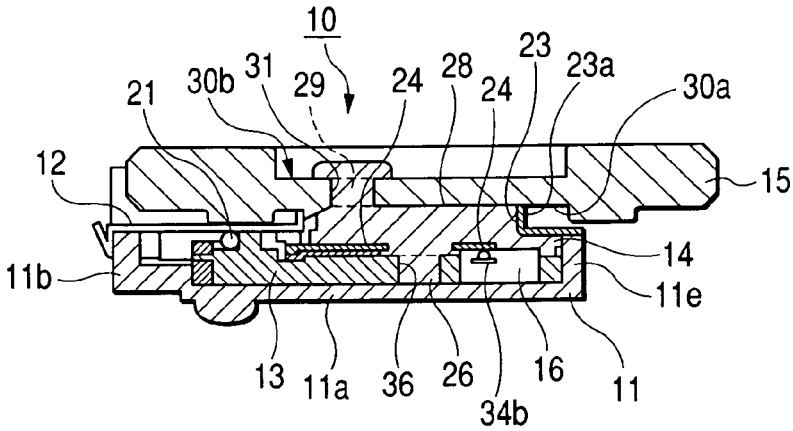
FIG. 1 is a longitudinally sectional view showing a composite operation type switch device according to an embodiment of the present invention.
Figure 2:
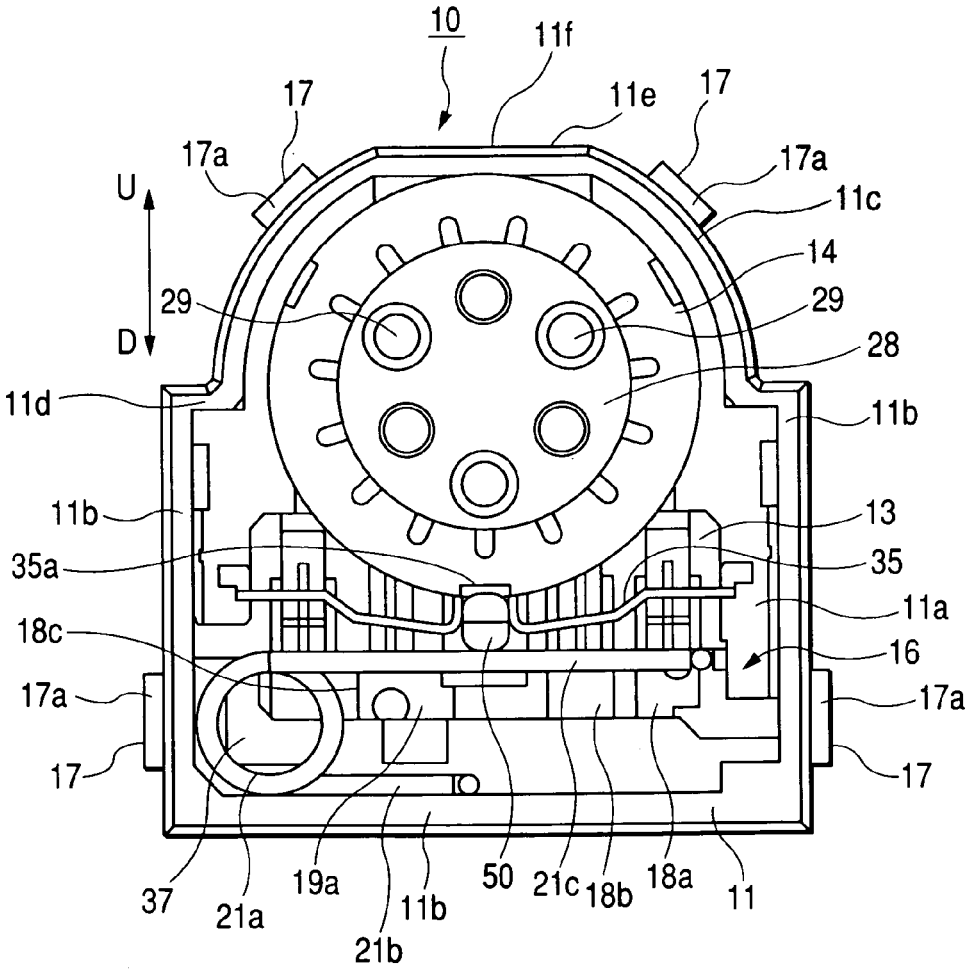
FIG. 2 is a plan view showing an inner structure of the composite operation type switch device of the embodiment.
Figure 3:
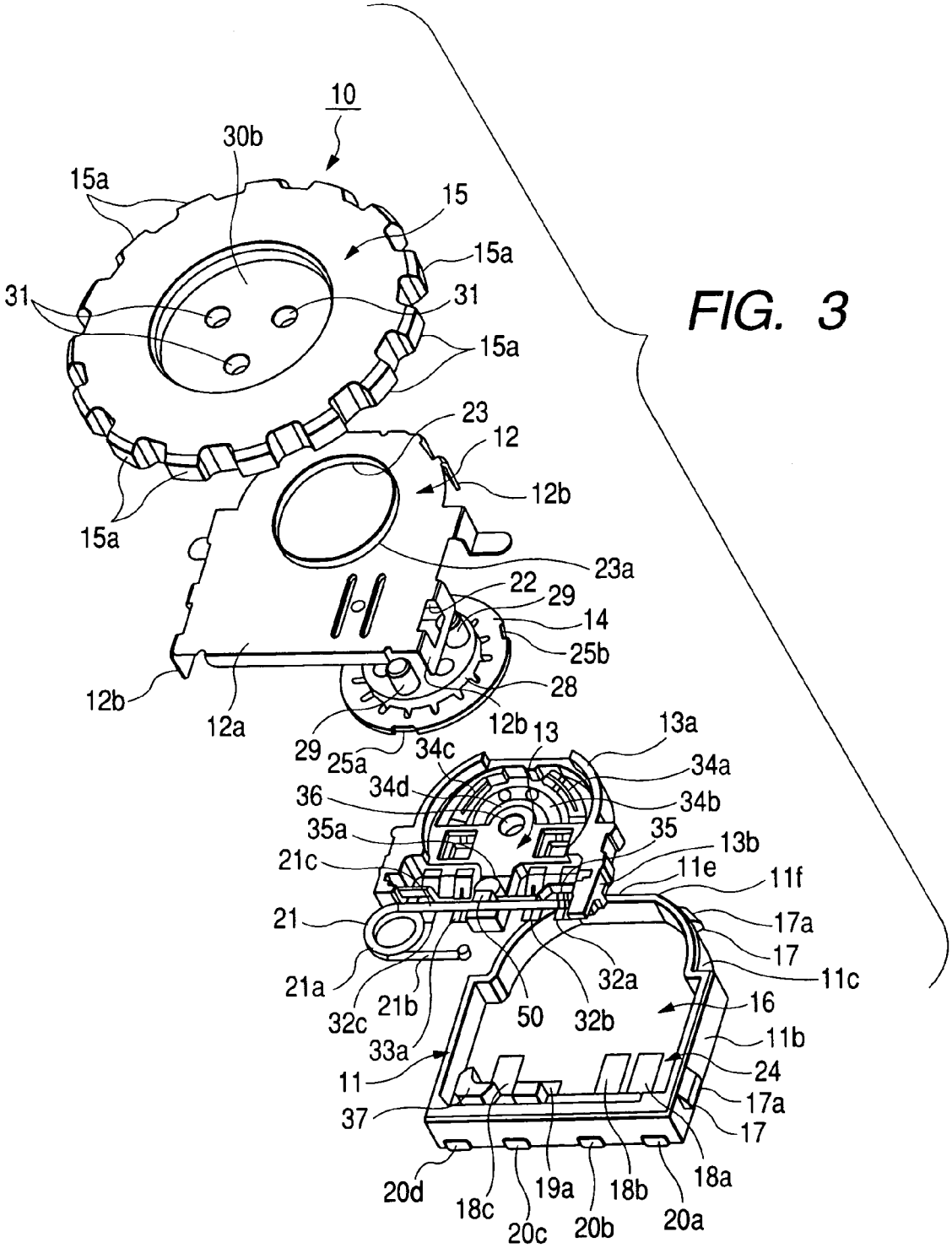
FIG. 3 is an exploded perspective view showing a primary portion of the composite operation type switch device of the embodiment.
Figure 4:
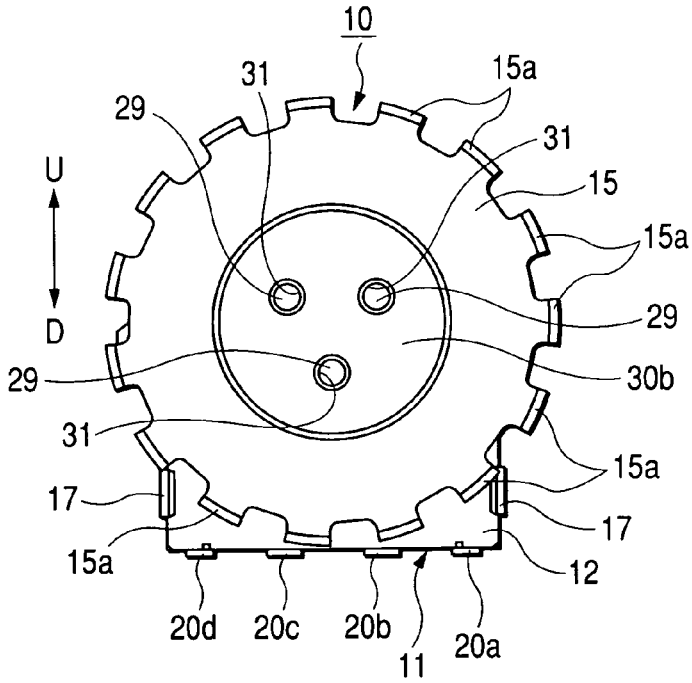
FIG. 4 is a front view of the composite operation type switch device of the embodiment.
Figure 5:
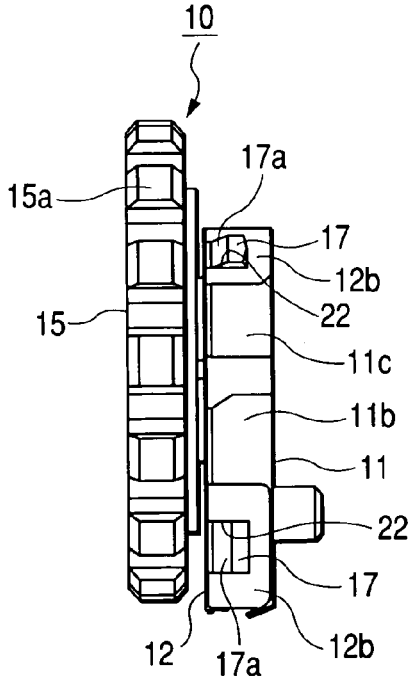
FIG. 5 is a side view of the composite operation type switch device of the embodiment.
Figure 6:
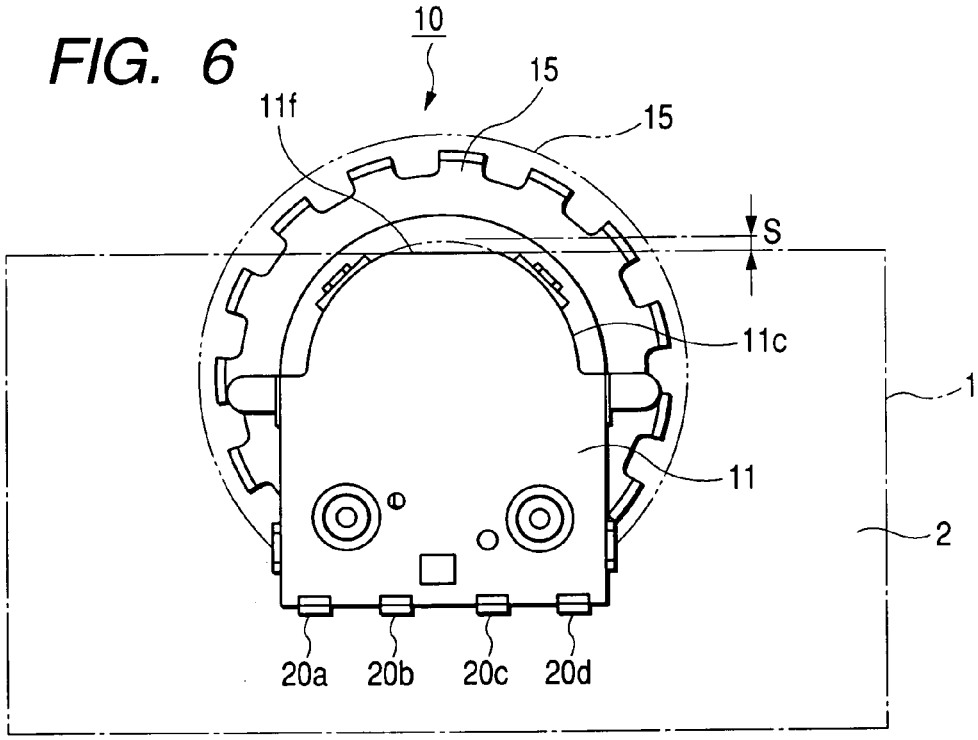
FIG. 6 is a rear view for explaining an action of the composite operation type switch device of the embodiment.
Figure 7:
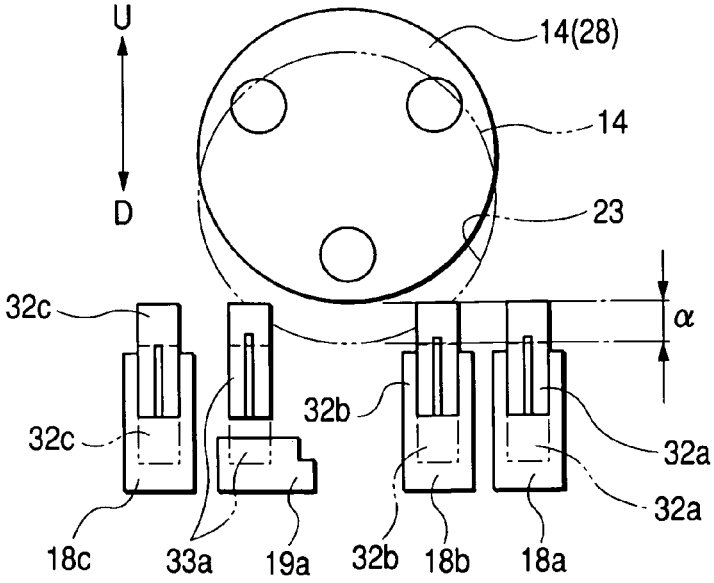
FIG. 7 is a schematic illustration for explaining an action of the composite operation type switch device of the embodiment.
Figure 8:
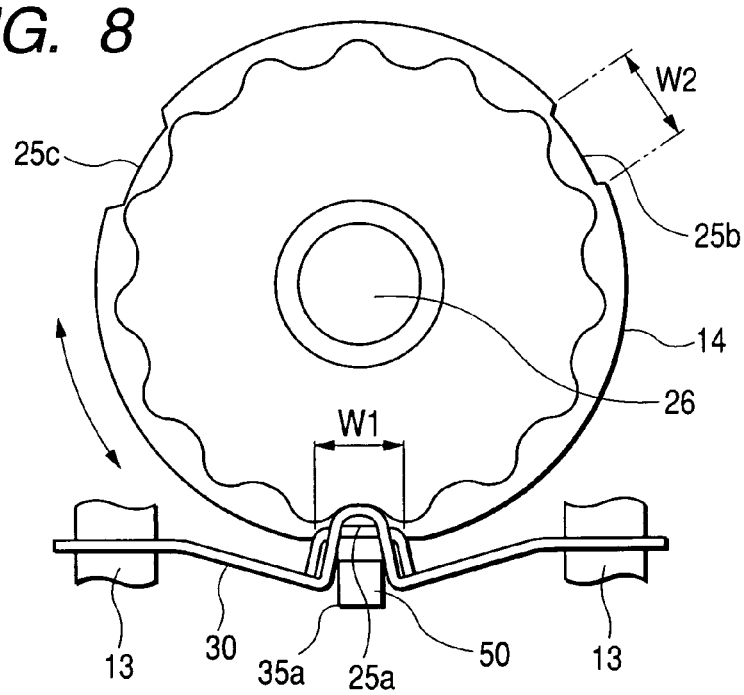
FIG. 8 is a schematic illustration for explaining a function of the spring for click feeling of the composite operation type switch device of the embodiment.

FIGS. 1 to 8 are views showing an embodiment of the composite operation type switch device of the present invention. FIG. 1 is a longitudinal sectional view of the composite operation type switch device, FIG. 2 is a plan view of the composite operation type switch device from which the dial member and cover are removed so as to show the inner structure, FIG. 3 is an exploded perspective view showing a primary portion of the composite operation type switch device, FIG. 4 is a front view of the composite operation type switch device, FIG. 5 is a side view of the composite operation type switch device, FIG. 6 is a rear view for explaining an action of the composite operation type switch device, FIG. 7 is a schematic illustration for explaining an action of the composite operation type switch device, and FIG. 8 is a schematic illustration for explaining a function of the spring for click feeling.

As shown in FIGS. 1 to 8, the composite operation type switch device 10 includes: a base 11, a cover 12, a slide member 13, a rotary plate 14 and a dial member 15. The composite operation type switch device 10 is operated as follows. When the dial member 15 is rotated, the first rotary switching function described later, which is composed of the rotary plate 14 and the slide member 13, is operated. When the slide member 13 is pushed forward in the sliding direction (in the direction of arrow D in FIGS. 2, 4 and 6), the rotary plate 14 and the dial member 15 are integrally slid forward in the sliding direction together with the slide member 13, and the second slide switching function described later, which is composed of the slide member 13 and the base 11, is operated. As described above, according to the different actions of rotating operation and pushing operation of one dial member 15, the rotating function and the slide switching function, which are different from each other, can be respectively operated. The structure will be explained in detail as follows.

The base 11 is made of, for example, resin. The base 11 includes: a bottom wall 11*a*; and side walls 11*b* and 11*c* substantially perpendicularly protruding upward from the bottom wall 11*a*. The side wall 11*b* is formed as a frame like wall which has a substantially quadrangle shape. Further, a part of the frame like wall at a side adjacent to the side wall 11*c* is notched. On the other side, the side wall 11*c* is formed as a frame like wall having a semilunate shape. The side wall 11*b* and the side wall 11*c* are connected by a connection portion 11*d*. The connection portion 11*d* connect recessed both side ends of the side wall 11*b* to opened both side ends of the side wall 11*c* so that a continuous periphery wall is formed on the bottom wall 11*a*. Due to the above structure, the bottom face and the side face of the containing portion 16 are completely closed by the bottom wall 11*a* and the side wall 11*b*. Accordingly, it is possible to prevent flux from intruding into the containing portion 16 from the outside.

Further, the side wall 11*c* is so configured that a minor diameter of the side wall 11*c* is slightly larger than a major diameter of the rotary plate 14. A peak of outer face of the side wall 11*c* is notched in a direction perpendicular to a push direction P of the slide member 13 (a slide direction of the slide member 13) so that the a notch portion (a recessed portion) lie is formed. The peak of the side wall 11*c* is a contact part of the slide wall 11*c* which contacts the slide member 13 when the slide member 13 moves to a rear side of the slide direction. The notch portion 11*e* reduces the height of the peak of the side wall 11*c* and an outer face 11*f* is came close to a center side of the dial member 15.

On the outer face of the side wall 11*b* of the base 11, four engaging pawls 17, which substantially perpendicularly protrude outside from the side wall 11*b*, are provided, wherein the shape of each pawl 17 is substantially rectangular. In this case, two of the engaging pawls 17 are provided on the right, and the other two of the engaging pawls 17 are provided on the left. On the upper face of each engaging pawl 17, the slope 17*a*, which gradually comes down to the side wall 11*b* side when it proceeds upward, is formed.

Further, on the inner face of the bottom wall 11*a* of the base 11, at a position of the forward end of the slide member 13 in the sliding direction, the conductive pattern 24 (shown in FIG. 3), on which the stationary contact point elements 18*a*, 18*b*, 18*c* and the switching element 19*a* are provided being slenderly extended in the sliding direction (the direction shown by arrow D–U in FIGS. 2, 4 and 6), is formed. The switch element 19*a* is an element composing the second switching function for sliding operation, which is provided between the base 11 and the slide member 13, together with the second sliding piece 33*a* described later. The external terminals 20*a*, 20*b*, 20*c*, 20*d*, which are inserted in the case of forming the base 11 and integrated with the base 11 into one body, are connected to the stationary contact point elements 18*a*, 18*b*, 18*c* and the switch element 19*a*. The stationary contact point elements 18*a*, 18*b*, 18*c* and the switch element 19*a* are electrically connected to the outside via the external terminals 20*a*, 20*b*, 20*c*, 20*d*. In this connection, the stationary contact point elements 18*a*, 18*b*, 18*c* and the switch element 19*a* are previously formed with the respectively corresponding external terminals 20*a*, 20*b*, 20*c*, 20*d* integrally. Thus integrated body maybe inserted when the base 11 is formed so that it can be integrated with the base 11 into one body.

Further, on the inside bottom face of the base 11, the protruding portion 37 for attaching the return spring is integrally formed at the forward end in the sliding direction on one side in such a manner that the protruding portion 37 for attaching the return spring is protruded upward from the bottom face wall 11*a*. The return spring 21 is attached to the protruding portion 37 for attaching the return spring.

The return spring 21 is a torsion spring composed in such a manner that the ring-shaped portion 21*a* is provided in the middle of a long rod-shaped steel member and both free end portions 21*b*, 21*c* are respectively expanded outside and extended in the same direction. The return spring 21 is incorporated into the base 11 as follows. The protruding portion 37 for attaching the return spring is inserted into and engaged with the ring-shaped portion 21*a* of the return spring 21, and both free end portions 21*b*, 21*b* are spring-compressed to each other, so that one free end portion 21*b* can be contacted with the inner face of the side wall 11*b* and the other free end portion 21*c* can be engaged with the connecting portion 13*b* provided in the slide member 13, and the slide member 13 can be given a pushing force in one direction (in the direction of arrow U in FIG. 2) at all times. In this connection, the slide member 13, which has been given a pushing force from the return spring 21, collides with an inner face of the side wall 11*b* of the base 11 at the rear in the direction of arrow U, that is, in the sliding direction, so that the slide member 13 can be positioned. This position, at which the slide member 13 has been positioned by collision, is the reference position of the slide member 13.

The cover 12 is composed of a metallic sheet, for example, the cover 12 is composed of a metallic sheet made of copper alloy by means of press forming. The cover includes a main body portion 12*a*, the size of which is capable of covering an upper face of the base 11. At positions corresponding to the engaging pawls 17 provided on the base 11, the engaging pieces 12*b* respectively having an engaging hole 22 are formed in such a manner that each engaging piece 12*b* is bent at a substantially right angle from the main body portion 12*a* toward the lower side. In this connection, the engaging pieces 12*b* can be elastically deformed.

In the main body portion 12*a* of the cover 12, the through-support hole 23 is provided corresponding to the portion in which the dial member 15 is attached. A peripheral edge of the through-support hole 23 is bent so that the entire peripheral edge can be a little protruded upward from the main body portion 12*a*. The edge portion 23*a* composed of the bent portion is provided on the entire circumference of the through-support hole 23. In this connection, the shape of the through-support hole 23 is not a true circle but an ellipse in which the inner diameter in the sliding direction (in the direction of arrow D–U in FIGS. 2, 4 and 6) of the slide member 13 is a little larger by the length $\alpha$. The length a is equal to a sliding length (sliding length $\alpha$ shown in FIG. 7) of the slide member 13.

The rotary plate 14 is a disk-shaped member made of resin. As shown in FIG. 8, the shaft portion 26 is formed at the center on the lower face side of the rotary plate 14 toward the lower side of the rotary plate 14. A conductive pattern and recess portions are formed around the shaft portion 26. The conductive pattern has switch elements (not shown) composing the first rotary switching function together with the sliding pieces 34*a* to 34*d* described later. The recess portions 25 for click feeling are repeatedly, continuously provided on the outer circumference of the rotary plate 14 in circumferential direction. On the other hand, a shaft portion 28 having a circular shape is provided at the center of the upper face side of the rotary plate 14. The outer diameter of the shaft portion 28 is substantially the same as the minimum inner diameter of the through-support hole 23 of the cover 12. Therefore, the shaft portion 28 can be inserted into the through-support hole 23 from the lower side of the cover 12. Further, on the end face of the shaft portion 28, three protruding pins 29 are integrally formed toward upward.

The dial member 15 is composed of a relatively thick disk-shaped member made of resin. A plurality of teeth 15*a* are provided on the circumferential face of the dial member 15 at regular intervals so that a user can be easily rotated the dial member 15 with the fingers. The recess portions 30*a*, 30*b* are provided at the center on the upper and the lower face. The portions in which the recess portions 30*a*, 30*b* are formed are thin, and three attaching holes 31 are formed in the recess portions 30*a*, 30*b*. The inner diameter of the recess portions 30*a*, 30*b* is determined as follows. The inner diameter of the recess portions 30*a*, 30*b* is sufficiently larger than the maximum outer diameter of the through-support hole 23 of the cover 12, and when the edge portion 23*a* is accommodated in the recess 30*a*, the dial member 15 can be freely moved by the sliding length $\alpha$ of the slide member 13. Positions at which the three attaching holes 31 are formed correspond to the three protruding pins 29 formed in the shaft portion 28 of the rotary plate 14. The length of the protruding pins 29 is sufficiently larger than the wall thickness of the recess portions 30*a*, 30*a*.

The slide member 13 includes an annular portion 13*a* made of resin, the shape of which is substantially annular, and a connecting portion 13*b* crossing the annular portion 13*a*. The slide member 13 is arranged in the containing portion 16 of the base 11 so that the slide member 13 can be slid in the direction of arrow D–U in FIGS. 2, 4 and 6. In the connecting portion 13*b*, the bearing hole 36 for pivotally accepting the shaft portion 26 of the rotary plate 14 is provided at the center. The first sliding pieces 32*a*, 32*b*, 32*c*, 32*d*, which are respectively composed of an elastic metallic sheet supported by the cantilever system, and the second sliding piece 33*a* are protruded downward from the connecting portion 13*b* to the front in the sliding direction (in the direction of arrow D in FIG. 2). The sliding pieces 34*a*, 34*b*, 34*c*, 34*d*, which are respectively composed of an elastic metallic sheet supported by the cantilever system, are protruded upward from the connecting portion 13*a* to the rear in the sliding direction (in the direction of arrow U in FIGS. 2, 4 and 6).

Further, in the connecting portion 13*b* of the slide member 13, the spring 35 for click feeling, for example, made of metal, by which a feeling of click is given to the rotary plate 14 when the dial member 15 is rotated, is attached in such a manner that the connecting portion 13*b* crosses in the lateral direction, and both end portions of the spring 35 for click feeling are fixed to the slide member 13. FIG. 8 is a schematic illustration in which a portion of the structure of the spring 35 for click feeling and a portion of the rotary plate 14 are shown being enlarged. As can be seen in FIG. 8, at the center of the spring 35 for click feeling, the protruding portion 35*a*, which is bent upward into a substantial C-shape, is provided. This protruding portion 35*a* is pushed at all times to a circumferential face of the rotary plate 14, on which the recess portions 25 for click feeling are formed. Therefore, when the rotary plate 14 is rotated and the protruding portion 35*a* corresponds to the recess portions 25 for click feeling, the protruding portion 35*a* drops into the corresponding recess portion 25 for click feeling. When the rotary plate 14 is continuously rotated, the protruding portion 35*a* comes out from the recess portion 25 for click feeling. In this way, the protruding portion 35*a* is engaged with and disengaged from the recess portion 25 for click feeling. Due to this engagement and disengagement, a feeling of click can be obtained.

An outer shape of the protruding portion 35*a* of the spring 35 for click feeling is substantially the same as an inner shape of the recess portions 25 for click feeling of the rotary plate 14. When the protrusion 35*a* is engaged with the recess portion 25 for click feeling of the rotary plate 14, no play is formed between the protrusion 35*a* and the recess portion 25 for click feeling of the rotary plate 14, that is, the protrusion 35*a* is tightly engaged with the recess portion 25 for click feeling of the rotary plate 14. Accordingly, when the protrusion 35*a* is engaged with any recess portion 25 for click feeling, as long as a strong force is not given to the protrusion 35*a* from the outside, no rattle is caused in the protrusion 35*a* in the lateral direction, and the protrusion 35*a* can be stationarily held at the position. When torque, the intensity of which is higher than that of the holding force of the spring for click feeling, is given from the outside, the spring 35 for click feeling is elastically deformed, and the protrusion 35*a* is released outside so that the rotary plate 14 can be allowed to rotate.

The protrusion 35*a* of the spring 35 for click feeling is engaged with the central protrusion 50 provided in the slide member 13. Therefore, deflection of the rotary member 14 in the lateral direction caused by rotation can be prevented, and the stopping position of the dial member 15 can be prevented from fluctuating.

Next, assembling of the composite operation type switch device composed as described above will be explained below. First, the slide member 13 is arranged in the containing portion 16 on the base 11 so that the annular portion 13*a* of the slide member 13 can be arranged on the rear side in the sliding direction and the connecting portion 13*b* can be arranged on the forward side in the sliding direction.

Next, the ring-shaped portion 21*a* of the return spring 21 is engaged with the protruding portion 37 to which the return spring is attached, and one end 21*b* of the return spring 21 is contacted with the side wall 11*b* of the containing portion 16 and the other end 21*c* is hooked at the connecting portion 13*b* of the slide member 13. Due to the foregoing, the slide member 13 is given a spring force from the return spring 21 at all times so that the slide member 13 can be moved backward in the sliding direction. Therefore, the slide member 13 is usually arranged at the rear in the sliding direction, that is, at the reference position. In the containing portion 16, the first sliding pieces 32*a*, 32*b*, 32*c* of the slide member 13 respectively correspond to the stationary contact point elements 18*a*, 18*b*, 18*c* on the base 11 side, and the second sliding piece 33*a* corresponds to the switching element 19*a* on the base 11 side.

In this connection, the structure of this embodiment is composed as follows. A positional relation between the sliding pieces 34*a* to 34*d* and the elements 18*a*, 18*b*, 18*c*, 19*a* with respect to the position of the rotary plate 14, which is slid integrally with the dial member 15 and the slide member 13, is schematically shown in FIG. 7. The first sliding pieces 32*a*, 32*b*, 32*c* and the stationary contact points 18*a*, 18*b*, 18*c* of the elements are contacted with each other at all times even when the rotary plate 14 is located together with the dial member 15 either at the rear position (at the position shown by the solid line in FIG. 7) in the sliding direction or at the forward position (at the position shown by the one-dotted chain line in FIG. 7) which is a position determined when the rotary plate 14 is slid forward from the rear position by the distance α. On the other hand, the second sliding piece 33*a* and the switch element 19*a*, which compose the second switching function, are separated from each other when the rotary plate 14 is located at the rear position in the sliding direction together with the dial member 15, and the second sliding piece 33*a* and the switch element 19*a* are contacted with each other when the rotary plate 14 is located at the forward position in the sliding direction.

Next, the rotary plate 14 is attached onto the slide member 13. In this attaching work, the shaft portion 26 of the rotary plate 14 is inserted into the bearing hole 36 of the slide member 13, and the spring 35 for click feeling is made to come into contact with the circumferential face of the rotary plate 14 on which recess portions 25 for click feeling are formed. When the rotary plate 14 is arranged on the slide member 13, the forward end portions of the elastic sliding pieces 34*a* to 34*d* on the slide member 13 side are made to come into pressure contact with the switch elements of the conductive pattern formed on the lower face of the rotary plate 14.

Next, the cover 12 is attached to the base 11 from an upper position of the rotary plate 14. When the cover 12 is attached at this time, the engaging pieces 12*b* of the cover 12 are made to correspond to the engaging pawls 17 of the base 11, and the cover 12 is pushed toward the base 11. When the cover 12 is pushed toward the base 11 at this time, the engaging pieces 12*b* are moved along the outside of the side wall 11*b* and 11*c*. In the middle of the movement, the engaging pieces 12*b* collide with the engaging pawls 17. However, in the engaging pawls 17, the slopes 17*a* are formed which collide with the forward end portions of the engaging pieces 12*b*. Therefore, when the engaging pieces 12*b* collide with the engaging pawls 17, each engaging piece 12*b* follows the slope 17*a* by its elastic deforming property and is deflected and released outside. When the engaging holes 22 have passed through the engaging pawls 17 the engaging pieces 12*b* are elastically returned, and the engaging holes 22 and the engaging pawls 17 are engaged with each other. Due to this engagement of the engaging holes 22 with the engaging pawls 17, the cover 12 can be prevented from coming out from the base 11.

On the other hand, when the cover 12 is attached to the base 11, the shaft portion 28 of the rotary plate 14 is inserted into the through-support hole 23 from the lower side of the cover 12, and the upper face of the rotary plate 14 comes into contact with the lower face of the cover 12. Further, three protruding pins 29 of the rotary plate 14 protrude upward from the upper face of the cover 12.

Next, three attaching holes 31 of the dial member 15 are respectively made to correspond to the protruding portions 29, and the protruding pins 29 are inserted into the attaching holes 31. In this state, the lower face of the dial member 15 comes into contact with the upper face of the cover 12, and the upper face of the rotary plate 14 comes into contact with the lower face of the cover 12. Further, the protruding pins 29 greatly protrude into the recess portions 30*b*.

Next, the protruding pins 29 protruding into the recess 30*b* are calked in the recess 30*b* so that the protruding pins 29 can not come out. FIG. 1 is a view showing a state in which calking has been completed. Due to this calking, the dial member 15, the rotary plate 14 and the cover 12 are integrated into one body, and the assembling work is completed. In this connection, either hot calking or cold calking may be adopted in this case.

Figure 9:
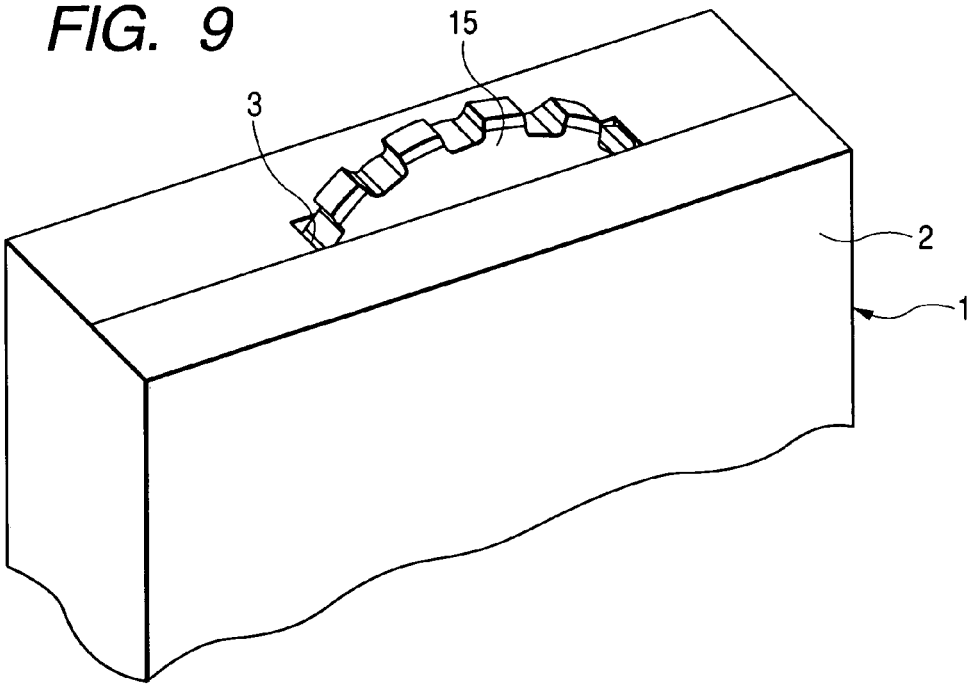
FIG. 9 is an exploded perspective view showing a substantial part of a device in which the composite operation type switch device of the embodiment is used.

As shown in FIGS. 6 and 9, in the composite operation type switch device 10 assembled in this way, in the case 2 of the device 1, an outer face 11*f* of the notch portion 11*e* is abutted against an inner face of the case 2 to position the base 11 with respect to the case 2 so that a part of the dial member 15 is protruded from an opening window 3 of the case 2 to an exterior. In this situation, the base 11 is fixed to the case 2 for use by an instrument (not shown). FIG. 9 shows the situation that the composite operation type switch device 10 is assembled in the case 2 of the device 1.

The dial member 15, the rotary plate 14 and the slide member 13 are moved backward in the sliding direction, that is, the dial member 15, the rotary plate 14 and the slide member 13 are moved to the reference position by a spring force of the return spring 21. When a user picks up the operation portion 15*b* of the operation member 15 with the fingers and rotates it, the rotary plate 14 is rotated at the position together with the dial member 15 by the engagement of the through-support hole 23 with the shaft portion 28 and by the engagement of the bearing hole 36 with the shaft portion 28. Due to this rotation, positions of the switch elements 27 on the reverse side of the rotary plate 14 composing the first rotary switching function and positions of the sliding pieces 34*a* to 34*d* are changed. Signals generated at this time can be taken out via the sliding pieces 32*a*, 32*b*, 33*a*, the stationary contact point elements 18*a*, 18*b*, 18*c* and the external terminals 20*a*, 20*b*, 20*d*. Each time the dial member 15 is rotated by 120°, the protrusion 35*a* of the spring 35 for click feeling is engaged with and disengaged from the recess 25 of the rotary plate 14. Due to this engaging and disengaging action, a feeling of click can be transmitted to the dial member 15. According to this feeling of click, the user can recognize the rotating operation.

When the rotating operation is completed, the user pushes forward the dial member 15 in the sliding direction with the finger, and the dial member 15 is guided by the through-support hole 23. Then, the dial member 15, the rotary plate 14 and the slide member 13 are integrally slid forward in the sliding direction. By this sliding movement, the second sliding piece 33*a* comes into contact with the switch element 19*a*, and an operation signal of the second slide switching function can be taken outside via the external terminal 20*c*. When the pushing action given to the dial member 15 is released, the dial member 15, the rotary plate 14 and the slide member 13 are integrally, automatically returned to the rear in the sliding direction by a spring force of the return spring 21, that is, the dial member 15, the rotary plate 14 and the slide member 13 are integrally, automatically returned to the initial position. Therefore, the contact of the second sliding piece 33*a* with the switch element 19*a* is released.

As described above, in the composite operation type switch device 10 of this embodiment, when the dial member 15 is rotated, the first switching function, which is provided between the rotary plate 14 and the slide member 13, is operated. When the dial member 15 is pushed in the direction of arrow D in FIG. 4, the rotary plate 14 and the slide member 13 are slid in the direction of arrow D together with the dial member 15, and the second switching function provided between the slide member 13 and the base 11 is operated. In this way, according to the different actions of rotating operation and pushing operation of one dial member 15, the rotating function and the slide switching function, which are different from each other, can be respectively operated.

Accordingly, in the composite operation type switch device 10 composed as described above, on the base 11, the upper face of which is covered with the cover 12, the containing portion 16, which is surrounded by the bottom wall 11*a* and the side wall 11*b*, is formed, and the element members composing the switch are arranged in the containing portion 16. Accordingly, even when reflow solder comes into contact with the lower face of the base 11 in the case where reflow soldering is conducted on the composite operation type switch device 10, since no gaps are formed on the bottom face and the side of the base 11, flux can not be allowed to intrude into the containing portion 16. Accordingly, there is no possibility that flux intrudes into the switch device in the process of reflow soldering. Therefore, it is possible to provide a composite operation type switch device to which reflow soldering can be suitably applied.

The elastic sliding pieces 34*a* to 34*d* of the cantilever system slide on the conductive pattern of the rotary plate 13 being pushed at all times. Therefore, this structure is advantageous in that the conductive pattern in the first switch SW1 and the sliding pieces 34*a* to 34*d* are excellently contacted with each other at all times.

Further, the sliding pieces 32*a* to 32*c* slide on the stationary contact point elements 18*a* to 18*c* of the base 11 being pushed at all times. Therefore, this structure is advantageous in that the stationary contact point elements 18*a* to 18*c* and the sliding pieces 32*a* to 32*c* can be excellently contacted with each other at all times.

Further, when the user releases an external force given to the dial member 15 in the sliding direction, the dial member 15 and the slide member 13 are automatically returned to the initial position by a spring force of the return spring 21 at all times. Therefore, this structure is advantageous in that the operation property can be enhanced.

Further, when the protrusion 35*a* of the spring 35 for click feeling is engaged with and disengaged from the recess 25 for click feeling, a feeling of click can be generated. Accordingly, the user can easily recognize a quantity of rotation of the dial member 15 by the feeling of click. Therefore, it is possible to expect enhancement in the operation property.

An outside shape of the protrusion 35*a* of the spring 35 for click feeling is substantially the same as an inside shape of the recess portion 25 for click feeling of the rotary plate 14. When the protrusion 35*a* is engaged with the recess portion 25 for click feeling of the rotary plate 14, no play is formed between the protrusion 35*a* and the recess portion 25 for click feeling of the rotary plate 14, that is, the protrusion 35*a* and the recess portion 25 for click feeling of the rotary plate 14 are tightly engaged with each other. Accordingly, when the rotary plate 14 is stopped at a position where a feeling of click can be obtained because the protrusion 35*a* of the spring 35 for click feeling is engaged in the recess portion 25 for click feeling of the rotary plate 14, the rotary plate 14 and the dial member 15 can be held under the condition that no rattle is caused in the rotating direction at the position where the rotary plate 14 is stopped.

When the engaging pieces 12*b* provided on the cover 12 are slid on both sides of the base 11, the engaging holes 22 of the engaging pieces 12 are engaged with the engaging pawls 17. Due to this engagement, the cover 12 can not come out of the base 11, and the cover 12 can be easily attached to the base 11. Accordingly, the assembling work can be simplified.

The protruding pin 29 of the rotary plate 14 is protruded from the inside of the cover 12 to the outside of the cover 12 via the through-support hole 23, and the thus protruded protruding pin 29 is inserted into the attaching hole 31 of the dial member 15, and the protruding pin 29, which has penetrated the attaching hole 31, is calked outside the dial member 15. Due to the foregoing, the dial member 15 and the rotary plate 14 are pivotally, slidably integrated into one body while the cover 12 is being interposed between them. Therefore, the assembling work can be simplified.

Since both sides of the rotary plate 14 are supported by the through-support hole 23 of the cover 12 and the bearing hole 36 of the slide member 13, the rotary plate 14 and the dial member 15 connected with the rotary plate 14 can be stably held.

Further, the side wall 11*c* of the base 11, which is adjacent to the reference position provided as the rear end in the slide direction of the slide member 13, is provided with the notch portion lie in a direction perpendicular to the push direction of the dial member 15. The outer face 11*f* of the side wall 11*c* is provided so as to close to the center side of the dial member 15. Therefore, the outer periphery of the dial member 15 is largely protruded to an outside rather than the outer face 11*f* of the side wall 11*c* (the notch portion 11*e*) of the base member 11 by a closed amount of the outer face 11*f* of the side wall 11*c* to the center side of the dial member 15. In a case that the composite operation type switch device 10 is attached to the inside of the device 1 with reference to the outer face 11*f* of the side wall 11*c*, the composite operation type switch device 10 is entirely positioned toward an outer side of the device 1 by a notched amount in which the peak of the side wall 11*c* is notched by the notch portion 11*e*. As a result, the dial member 15 can be positioned to an outer side. Since the composite operation type switch device 10 can be entirely positioned toward an outer side of the device 1, the dial member 15 is largely protruded to the exterior from the device so that the structure to which the user can easily operate is achieved or a degree of freedom of the design is increased by decreasing the major diameter of the dial member 15 to miniaturize the composite operation type switch device 10.

Next, the above structure is more detailed explained by using FIG. 6. When the structure is not provided with the notch portion at the side wall 11*c* as shown by two dotted chain line of FIG. 6, the peak of the side wall 11*c* is larger than the side wall 11*c* provided with the notch portion 11*e* of the embodiment by the distance S. Therefore, in a case that the composite operation type switch device 10 is attached to the inside of the case 2 of the device 1 with reference to the outer face of the side wall 11*c*, it is required to enlarge the major diameter of the dial member 15 when the notch portion is not provided. However, in the embodiment, since the notch portion lie is provided, the entire device is located toward the outside by the notched amount (the distance S). As a result, the stroke of pushing operation of the dial member 15 is ensured without enlarging the major diameter of the dial member 15. Therefore, the miniaturization of the dial member 15 is realized, and also the miniaturization of an entire apparatus is realized, so that the design is increased.

In this connection, this embodiment discloses a structure in which the sliding pieces 32*a* to 32*c*, 33*a*, 34*a* to 34*d* are provided on the slide member 13 side and the conductive pattern is provided on the rotary plate 14 and the base side 11. However, it is possible to adopt a structure in which the conductive pattern is provided on the slide member 13 side and the sliding pieces are provided on the rotary plate 14 and the base side 11 on the contrary. In this case, the same effect as that of the case, in which the sliding pieces 32*a* to 32*c*, 33*a*, 34*a* to 34*d* are provided on the slide member 13 side and the conductive pattern is provided on the rotary plate 14 and the base side, can be also provided.

It should be noted that variations may be made by those skilled in that art without departing from the spirit and scope of the present invention.

What is claimed is:

1. A switch device, comprising:

a base member, which includes a containing portion, the containing portion having a bottom face, side faces and an upper opening;

a switching unit, which is slidably provided on the bottom face;

a cover member, which is attached to the base member so as to cover the upper opening of the containing portion, and the cover member having an operation hole;

an operating member, which rotates for a first switching function and which slides in a sliding direction for a second switching function; and a connecting portion, which connects the operating member with the switching unit through the operation hole, wherein the switching unit includes a rotary member and a slide member;

wherein the rotary member is connected to the connecting portion and has a first switch element for the first switch function;

wherein the slide member is connected to the rotary member by the connecting portion, and slides on the bottom face together with the rotary member in the sliding direction;

wherein the base member includes a plurality of fixed contact elements and a second switch element for the second switching function which are provided on the bottom face of the containing portion; and wherein the slide member has a plurality of movable slide elements, which slidably contact the plurality of fixed contact elements and the second switch element respectively, and has a second slide element, which slidably contacts the first switch element.

2. The switch device as set forth in claim 1, wherein the containing portion is embedded in the base member.

3. The switch device as set forth in claim 1, wherein the bottom face and the side faces are integrally formed so as to define a hermetically sealed space in the containing portion.

4. The switch device as set forth in claim 1, wherein the base member is made of resin.

5. The switch device as set forth in claim 1, wherein the first switch element on the rotary member is formed as a conductive pattern; and wherein the second slide element is formed as an elastic slide piece in the cantilever manner, the elastic slide piece having a first end, which is fixed to the slide member, and a second end, which is urged to the conductive pattern on the rotary member constantly.

6. The switch device as set forth in claim 1, wherein the stationary contact element and the second switch element are formed as conductive patterns; and wherein the first slide element is formed as an elastic slide piece in the cantilever manner, the elastic slide piece having a first end, which is fixed to the slide member, and a second end, which is urged to the conductive pattern on the base member constantly.

7. The switch device as set forth in claim 1, further comprising a first urging member which is provided in the containing portion to urge the slide member in one direction constantly, wherein the first urging member has a first free end, which is abutted against the side face of the containing portion, and a second free end, which is abutted against the slide member.

8. The switch device as set forth in claim 1, wherein the rotary member has a recess portion on an outer circumference thereof;

wherein the slide member has a second urging member for click feeling coming into pressure contact with the outer circumference of the rotary member;

wherein the second urging member has a protrusion which is engaged with the recess portion; and wherein the click feeling is generated when the rotary member is rotated.

9. The switch device as set forth in claim 8, wherein an outer shape of the protrusion is substantially the same as an inner shape of the recess portion of the rotary member; and wherein the protrusion is substantially tightly engaged in the recess portion of the rotary member.

10. The switch device as set forth in claim 1, wherein the base member has a first engaging portion provided on a side face thereof;

wherein the cover member has a second engaging portion provided on a side edge thereof; and wherein the first engaging portion is engaged with the second engaging portion when the cover member is attached to the base member.

11. The switch device as set forth in claim 1, wherein the rotary member is made of resin;

wherein the connecting portion has a protruding pin which is provided on the rotary member;

wherein the operating member has an attaching hole through which the protruding pin passes;

wherein the protruding pin passes from one side of the operating member to the other side of the operating member through the attaching hole; and wherein a part of the protruding pin, which has passed to the other side of the operating member, is affixed so as to lock the protruding pin on the operating member so that the rotary member and the operating member are integrated with the cover member into one body.

12. The switch device as set forth in claim 1, wherein the rotary member has a shaft portion; and wherein the slide member has a bearing hole with which the shaft portion is rotatably engaged.

13. The switch device as set forth in claim 1, wherein a notch portion is formed on an outer periphery of the side wall of the containing portion at a rear end side in the sliding direction of the slide member.

14. The switch device as set forth in claim 13, wherein the notch portion of the containing portion is recessed toward a center side of the rotary member.

* * * * *